US007007413B2

(12) United States Patent
McMullin

(10) Patent No.: US 7,007,413 B2
(45) Date of Patent: Mar. 7, 2006

(54) INVERSE SHOE CLEAT ASSEMBLY AND METHOD OF INSTALLATION

(75) Inventor: Faris W. McMullin, Boise, ID (US)

(73) Assignee: Softspikes, LLC, Gaithersburg, MD (US)

( * ) Notice: Subject to any disclaimer, the term of this patent is extended or adjusted under 35 U.S.C. 154(b) by 0 days.

(21) Appl. No.: 10/880,467

(22) Filed: Jul. 1, 2004

(65) Prior Publication Data

US 2005/0000119 A1 Jan. 6, 2005

Related U.S. Application Data

(60) Provisional application No. 60/483,650, filed on Jul. 1, 2003.

(51) Int. Cl.
*A43B 5/00* (2006.01)

(52) U.S. Cl. ..... 36/134; 36/67 D

(58) Field of Classification Search ..... 36/67 R, 36/67 D, 134, 127
See application file for complete search history.

(56) References Cited

U.S. PATENT DOCUMENTS 1,799,334 A * 4/1931 Tubbs ..... 36/59 R
2,862,312 A * 12/1958 Melchiona ..... 36/59 R
3,127,687 A * 4/1964 HOllister et al. ..... 36/114
4,318,232 A * 3/1982 Ching ..... 36/73
4,414,763 A * 11/1983 Bente ..... 36/134
4,633,600 A * 1/1987 Dassler et al. ..... 36/134
4,644,672 A * 2/1987 Dassler et al. ..... 36/134
5,259,129 A 11/1993 Deacon et al.
5,321,901 A * 6/1994 Kelly ..... 36/134
5,367,793 A 11/1994 Deacon et al.
5,524,367 A * 6/1996 Ferreira et al. ..... 36/134
5,761,833 A 6/1998 McMullin
5,887,371 A 3/1999 Curley, Jr.
5,974,700 A 11/1999 Kelly
6,009,640 A 1/2000 Deacon et al.
6,023,860 A 2/2000 McMullin
6,052,923 A 4/2000 McMullin
6,094,843 A 8/2000 Curley, Jr.
6,167,641 B1 1/2001 McMullin
6,209,230 B1 4/2001 Curley, Jr.
6,248,278 B1 6/2001 Kelly
6,253,468 B1 * 7/2001 Hirota ..... 36/134
6,272,774 B1 * 8/2001 Kelly ..... 36/134
6,283,290 B1 9/2001 Thompson
6,305,104 B1 10/2001 McMullin
6,327,797 B1 12/2001 Deacon et al.
6,354,021 B1 3/2002 Deacon et al.
6,451,242 B1 9/2002 Kelly
6,631,571 B1 10/2003 McMullin
6,810,608 B1 11/2004 Kelly
6,823,613 B1 11/2004 Kelly
6,834,445 B1 12/2004 McMullin
6,834,446 B1 12/2004 McMullin

* cited by examiner

*Primary Examiner*—M. D. Patterson
(74) *Attorney, Agent, or Firm*—Edell, Shapiro & Finnan, LLC

(57) ABSTRACT

In a cleat connection assembly for replaceable cleats used on athletic shoes, a male engagement member is provided in the shoe-mounted connector element, and a recess in the cleat serves as a female connector element or receptacle for the male member. The male member projecting beyond the shoe sole is made of plastic material and is configured with a broad load bearing distal end to avoid damage to vulnerable surfaces engaged by that member when the cleat is removed from the shoe.

18 Claims, 4 Drawing Sheets

INVERSE SHOE CLEAT ASSEMBLY AND METHOD OF INSTALLATION

CROSS REFERENCE TO RELATED APPLICATIONS

This application claims priority from U.S. Provisional Patent Application Ser. No. 60/483,650, entitled "Shoe Cleat Connection Method And Apparatus", filed Jul. 1, 2003. The disclosure of this provisional patent application is incorporated herein by reference in its entirety.

BACKGROUND OF THE INVENTION

1. Technical Field

The present invention pertains to replaceable cleats for athletic shoes and, more particularly, in a preferred but not exclusive embodiment, for golf shoes. Although not so limited, the invention has primary application for plastic cleats.

2. Discussion of Related Art

It is conventional in connector structures for removable metal golf spikes to provide the male portion of the connector on the removable and replaceable cleat and to mount the female portion permanently mounted recessed in the shoe sole. Part of the traditional thinking behind this has been derived from the fact that conventional metal spikes are capable of damaging carpet, wooden floors, etc., when worn indoors. Thus, if the spikes are removed only the open and recessed receptacle is exposed, and the shoe can be worn indoors without causing damage.

The development of plastic replaceable cleats has followed the prior philosophy used for many years in relation to metal spikes. Specifically, all replaceable plastic cleats have male connector elements, typically in the form of threaded posts, that selectively engage a threaded recess in a female connector element permanently mounted in the sole of a shoe. Examples of such cleats are found in U.S. Pat. No. 5,259,129 (Deacon et al); U.S. Pat. No. 5,761,833 (McMullin); U.S. Pat. No. 5,794,367 (Carroll); U.S. Pat. No. 5,887,371 (Curley, Jr.); U.S. Pat. No. 5,974,700 (Kelly); U.S. Pat. No. 6,023,860 (McMullin); U.S. Pat. No. 6,052,923 (McMullin); U.S. Pat. No. 6,272,774 (Kelly); U.S. Pat. No. 6,463,681 (Savoie); U.S. Pat. No. 6,631,571 (McMullin); U.S. Patent Application Publication No. 20020056210 (Kelly et al); U.S. Patent Application Publication No. 2003/0188459 (Kelly et al); U.S. patent application Ser. No. 20040010944 (McMullin); and U.S. Patent Application Publication No. 20040040182 (McMullin). The disclosures from all of these patents and applications are expressly incorporated herein by reference. Although the overall disclosures of those patents/applications are incorporated herein, the specific connector components and means for attaching a cleat to a shoe are incorporated herein as applicable to the principles described below.

SUMMARY OF THE INVENTION

The present invention recognizes that the advent of plastic cleats has substantially eliminated damage to carpet and other interior flooring. In addition, the present invention recognizes that installation of a cleat on a shoe is simplified if the male portion of the connector is mounted on the sole of the shoe with the female portion provided in the cleat. This is a reversal in thinking for receptacles and posts used in connecting conventional cleats to shoes. Specifically, as described herein, the invention involves reversing the locations of the posts and receptacles, where the posts or the male portions of the connector are mounted on the shoe outsole and the receptacle or female portion is contained in the cleat body.

In a preferred embodiment, a mounting connector is molded into the sole of a golf shoe and includes a projecting male engagement member in the form of an exteriorly threaded shaft. A replaceable golf cleat is provided with a female receptacle in the form of a recess threaded to receive and engage the threaded shaft of the mounting connector. The shaft is typically made of plastic and provided with a flat or convex distal end to prevent it from damaging wooden floors, carpeting or similar surfaces when the cleat is removed and the wearer of the shoe treads on such surfaces. A ratcheting type locking arrangement is provided to resist relative rotation between the shaft and recess in a direction that would cause disengagement.

The invention advantageously permits a very simple installation procedure. Specifically, installation is accomplished by locating the recess in the cleat in alignment with the shaft of the shoe-mounted connector, and rotating the cleat clockwise (typically between 60° and 120°) until it snaps and locks into place. To remove the cleat, the cleat is rotated counterclockwise approximately 60°–120°. The size of the connecting elements is designed to maximize the material for strength, within the constraints of standard cleat sizes.

The invention pertains to: (1) the combination of the afore-described cleat and mounting connector, (2) the cleat and the mounting connector individually, (3) a shoe containing the combination, (4) the method of removably connecting the cleat and mounting connector, and (5) the method of configuring the cleat and connector combination.

The above and still further features and advantages of the present invention will become apparent upon consideration of the following definitions, descriptions and descriptive figures of specific embodiments thereof wherein like reference numerals in the various figures are utilized to designate like components. While these descriptions refer to specific details of the invention, it should be understood that variations may and do exist and would be apparent to those skilled in the art based on the descriptions herein.

DESCRIPTION OF THE PREFERRED EMBODIMENTS

Figure 1:
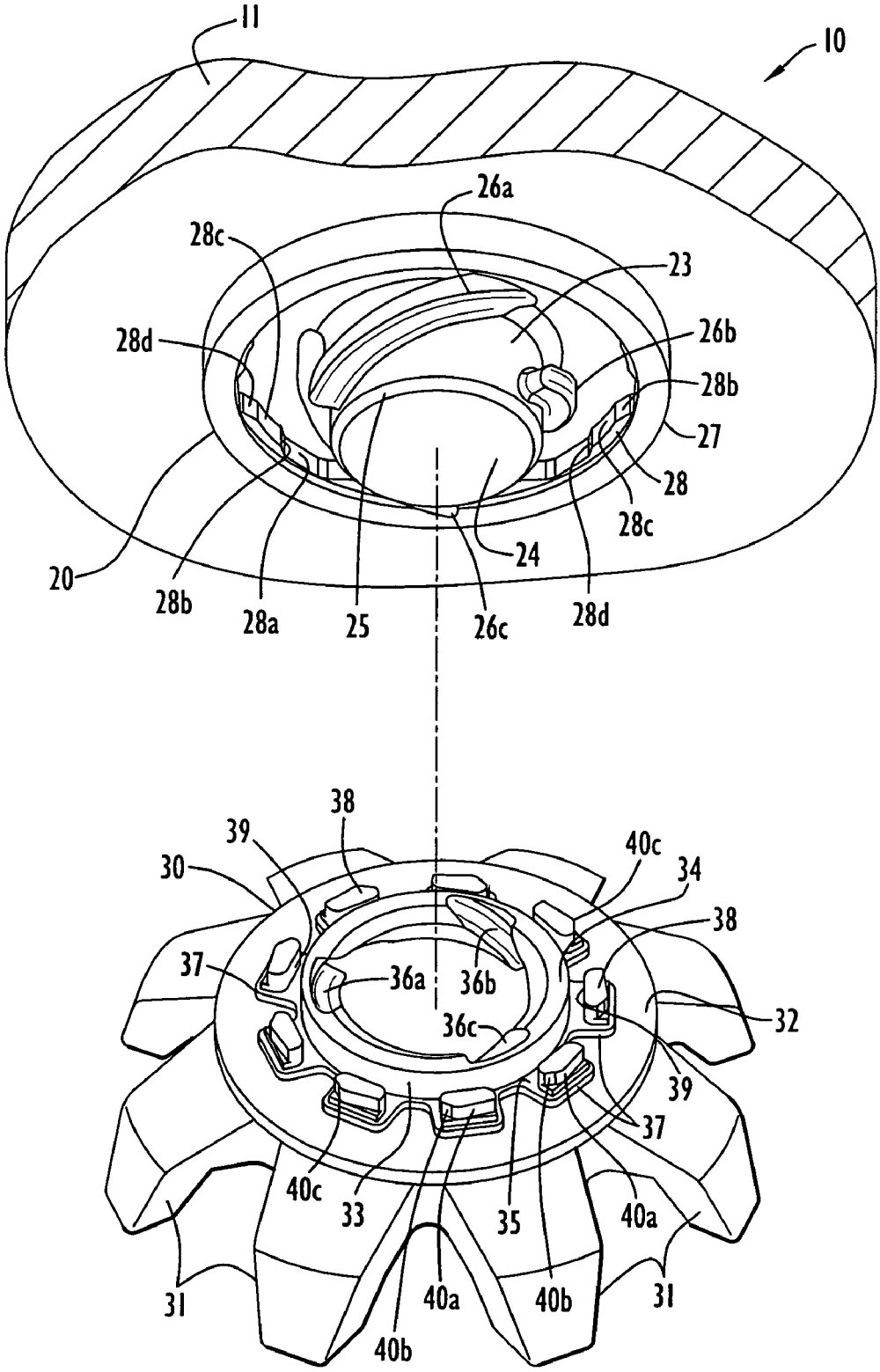
FIG. 1 is an exploded view in perspective of a cleat and shoe-mounted connector in an assembly according to one embodiment of the present invention.
Figure 2:
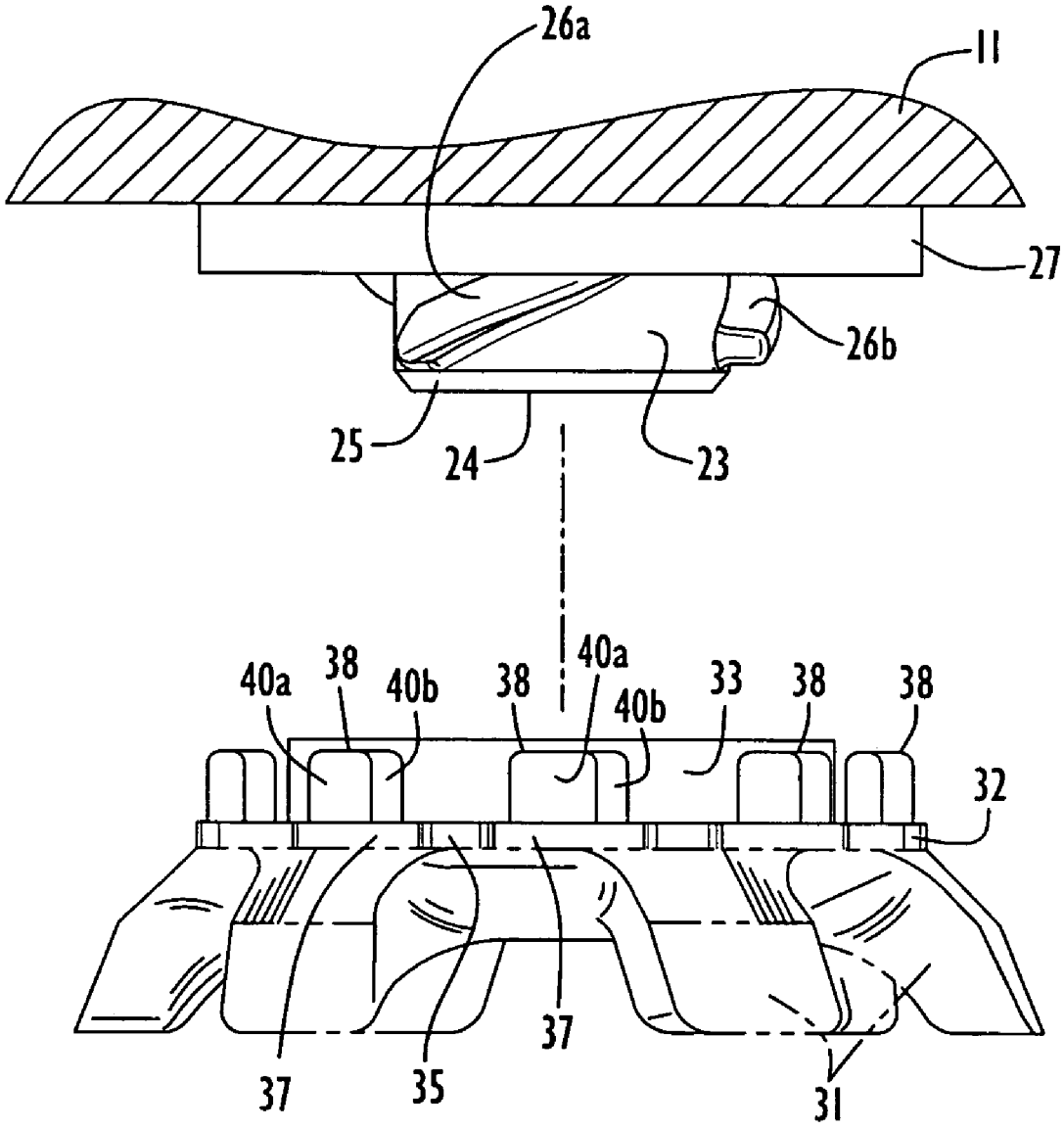
FIG. 2 is an exploded view in elevation of the assembly of FIG. 1.
Figure 3:
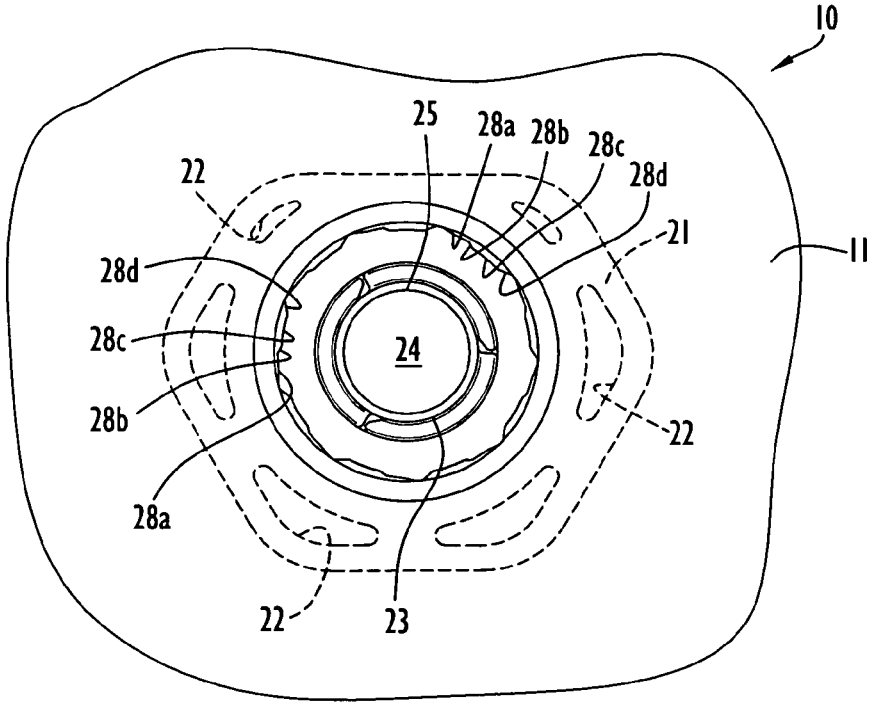
FIG. 3 is a bottom view in plan of the shoe-mounted connector according to the embodiment of FIG. 1.
Figure 4:
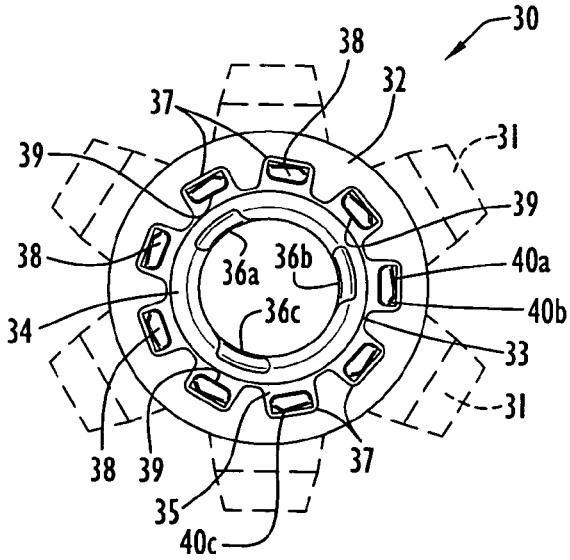
FIG. 4 is a top view in plan of the cleat of the embodiment of FIG. 1.

Referring to FIGS. 1–4 of the accompanying drawings, in accordance with a preferred embodiment of the present invention, a golf shoe 10 has a mounting connector 20 secured to its shoe sole 11. The body of connector 20 is typically embedded in the sole 11 and may be molded into the sole in a manner, for example, such as that disclosed in U.S. Pat. No. 6,248,278 (Kelly), the entire disclosure from which is incorporated herein by reference. Connector 20 includes a base or flange 21 having flat interiorly-facing and exteriorly-facing surfaces through which a plurality of apertures 22 are defined, typically to receive molten polymer or rubber of sole 11 during molding of the sole to optimize positional stability of the connector in the sole. A shaft 23 extends perpendicularly from the exteriorly-facing surface of base 21 and is typically a right cylinder with a flat distal end 24 oriented perpendicular to the shaft axis. An annular beveled section 25 separates the flat surface at distal end 24 from the cylindrical body of shaft 23. A multi-start thread is provided about the periphery of the cylindrical wall of shaft 23 and takes the form of three male helical thread segments 26*a*, 26*b* and 26*c*. These segments are angularly spaced by 120° about the shaft and extend from one end to the other of the shaft while traversing an angle of approximately 120° about the shaft.

An annular wall 27 extends axially from the exteriorly-facing surface of base 21 and is concentrically disposed about and spaced from the base of shaft 23. Annular wall 27 terminates in a flat annular distal surface parallel to base 21. Wall 27 is substantially shorter in axial length than shaft 23 and has an interior facing annular surface provided with a continuous series of angularly spaced short radial projections 28. Proceeding clockwise (or in the direction of rotation of a cleat during insertion), each of the projections 28 includes a relatively long planar ramp section 28*a* of relatively small slope inward from the annular wall, followed by and terminating in a short ramp section 28*b* of sharper inward slope and terminating at projection surface 28*c*. Projection surface 28*c* has approximately the same angular length or is slightly shorter than ramp section 28*a* and is substantially perpendicular to a radius from shaft 23 intersecting that surface at its angular center. Projection surface 28*c* is the most radially inward section of projection 28 and terminates in another short ramp section 28*d* which slopes back toward and intersects annular wall 27. The next projection 28 begins at the terminus of section 28*d* of the adjacent projection so that a continuous series of projections 28 extends along the inner surface of wall 27. There are nine projections 28 shown in the preferred embodiment; however, this is by no means a limiting feature of the invention since any number and shape of projections may be utilized in connection with the principles described herein.

The axial length of shaft 23 is approximately three times that of annular wall 27, and the axial length of wall 27 is approximately twice that of projections 28, although these dimensions are merely convenient for the disclosed embodiment and not limiting features. The radially inward distance that projection surfaces 28*c* extend from wall 27 is determined by the functional requirement that these surfaces contact locking posts on the cleat as described hereinbelow.

A cleat 30 includes a flange 32 having a ground-engaging side and a shoe sole-facing side. One or more traction elements 31 project downward from the ground engaging side and may have substantially any configuration suitable for providing the traction necessary for the sport or activity for which shoe 10 is worn. In the illustrated embodiment the cleat is a golf cleat and the traction elements are of the type described and illustrated in U.S. Pat. No. 6,305,104 (McMullin). A receptacle is provided on the sole-facing side of the cleat for receiving shaft 23 of the mounting connector. Specifically, the receptacle is defined by an annular wall 33 extending axially from flange 32 and terminating in an annular end wall 34 disposed perpendicular to wall 33. The recess defined radially inward of wall 33 is sized to axially receive at least a portion of the length of shaft 23 of the shoe-mounted connector. The radially inward-facing surface of wall 33 has three individual female spiral thread sections 36*a*, 36*b* and 36*c* defined therein at 120°-spaced locations. These thread sections each extend the axial length of the recess and along an angle about the recess of approximately 60° to 75°. Thread sections 36*a*, 36*b* and 36*c* are positioned and sized to receive thread sections 26*a*, 26*b* and 26*c* on shaft 23. In the illustrated embodiment any of the three sections 36*a*, 36*b* and 36*c* can engage any of sections 26*a*, 26*b* and 26*c*; in other words, there are three possible angular start orientations of the cleat relative to the shoe-mounted connector. Such an arrangement is typical for cleats having symmetrically disposed traction elements wherein there is no pre-determined required angular orientation of the cleat relative to the shoe. It will be appreciated, however, that some cleats may have specific required angular orientations relative to the shoe, and in those cases the thread sections can be designed to effect a single starting position of the cleat relative to the shoe-mounted connector.

A platform 35 is raised from the sole-facing side of flange 32 and is configured as a plurality (e.g., nine) of radially outward projections 37 from wall 33 along the flange. Atop each projection 37 is a respective post 38 employed in the locking function of the cleat. The number of posts 38 typically matches the number of projections 28 in the shoe-mounted connector, although this is not a requirement since there may be more or fewer posts than projections. Each post has a substantially planar, angularly elongated, radially inward-facing surface 39 and bi-faceted radially-outward facing surface 40. In particular, surface 40 includes two facets 40*a* and 40*b* which converge radially outwardly to intersect at a beveled edge 40*c*. The outward-facing facets in surface 40 are configured and positioned to engage the projections 28 in the shoe-mounted connector in the manner described hereinbelow. Facet 40*a* is the longer of the two facets and has the more gradual ramp slope. The axial terminus of posts 38 is spaced slightly less from flange 32 than the terminus (i.e., end wall 34) of annular wall 33.

In connecting the cleat 30 to the shoe-mounted connector 20, the cleat is placed proximate shaft 23 projecting from the shoe sole 11. When shaft 23 is properly aligned with the recess defined by wall 33, the cleat is rotated about the recess axis until thread sections 26*a*, 26*b* and 26*c* on shaft 23 engage thread sections 36*a*, 36*b* and 36*c* in the recess. As rotation continues in a clockwise direction, and the shaft becomes further inserted into the recess, the longer facets 40*a* on posts 38 slide smoothly over successive shallow ramp section 28*a*, thereby permitting deeper insertion of shaft 23 until its terminal end 24 abuts the base of the recess, preventing further clockwise rotation of the cleat. At this point the cleat is properly installed in the shoe-mounted connector. Inadvertent reverse or counter-clockwise rotation of the cleat is thereafter prevented by the abutment of the more sharply angled facet 40*b* on the cleat against the steeper ramp 28*c*. Of course, In order to remove the cleat for replacement, a tool may be employed in a conventional manner to apply a sufficiently large torque to rotatably drive facets 40*b* past the ramps 28*c*.

For most applications it is expected that the male engagement member (i.e., shaft 23 in the disclosed embodiment) in the shoe-mounted connector will project beyond the shoe sole. The plastic material used for that member, as well as the configuration of its distal end (i.e., not sharp, but instead a broad load-distributing surface) permits the shoes to be used when the cleats are removed without damaging vulnerable surfaces such as hardwood floors, carpeting, ceramic flooring, etc. The bevel section 25 at the distal end of the shaft eliminates a sharp annular edge surrounding end wall 24 to thereby further reduce the likelihood of damage to vulnerable surfaces. It should be noted that the planar end wall 24 is the most efficient configuration in distributing the shoe wearer's weight load; slightly convex rounded surfaces may also be employed. Optionally, end wall 24 may be coated with an epoxy or other friction-providing material to minimize slipping of the tip of the male engagement member on low friction floors and similar surfaces. Alternatively, the tip may be textured to achieve the same purpose.

Although the projecting male engagement member in the embodiment described above is a single shaft 23, it will be appreciated that a plurality of such members may be provided to engage an appropriately contoured female recess in a cleat. An example of such a connector is found in U.S. Pat. No. 6,631,571 (McMullin) noted and incorporated by reference hereinabove. Disclosed in that patent is a male connector employing three independent posts and a retaining member disposed at a distal end and extending radially from each post. The receptacle includes a cavity contoured to receive and engage the retaining members. In view of the present inventions the posts may be part of and project from the shoe-mounted connector, and the receptacle may be defined in the cleat.

The shoe-mounted connector 20 and cleat 30 are each preferably, but not necessarily, injection molded as individual one-piece units from one or more suitable plastic materials. The plastic material should be chosen to not only perform the desired traction for an athletic activity, but also to permit the projecting shoe-mounted connector to withstand loads on hard surfaces when the cleat is removed. Thermoplastic urethane resins (TPU), particularly those marketed as Dow Isoplast™ 101LGF60 NAT and Dow Isoplast™ 2560 NAT, are among the materials that are optimum for these purposes. That is not to say that other plastics, although less ideal, cannot be used. For example, and without limitation, suitable plastic materials include polycarbonates, polyamides (e.g., nylon), polyurethanes, natural or synthetic rubbers (e.g., styrene-butadiene), and other elastomeric polyolefins.

Figure 5:
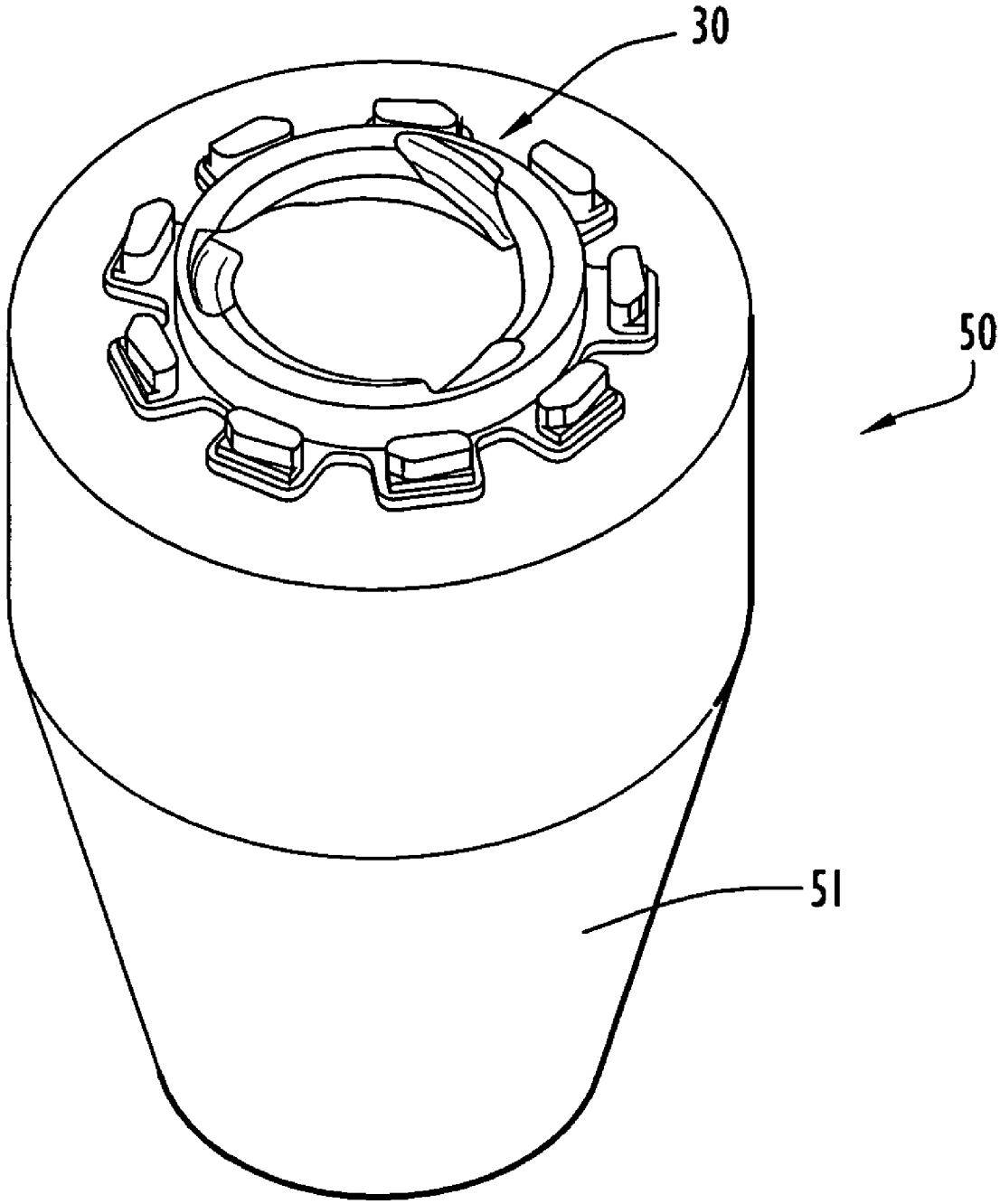
FIG. 5 is a view in perspective of a soccer cleat having a connector according to the present invention.

As noted herein, although the invention has been disclosed with primary application for golf shoes, the principles are equally applicable for cleated shoes of other types used in other athletic activities, such as soccer, football, baseball, etc. For example, with reference to FIG. 5 of the accompanying drawings, the receptacle connector in the cleat of FIG. 1 may be provided in a cleat 50 having a frusto-conical traction element 51 depending from the flange of the cleat. The female receptacle disposed in the top surface is otherwise substantially the same as described above for cleat 30.

It should also be understood that the connector arrangement of the present invention is not limited for use with plastic cleats. It is the male engagement member in the shoe-mounted connector that is required to be non-destructive of vulnerable flooring and other surfaces when the cleat is removed. Thus, plastic or similar material is necessary only for fabricating the projecting portions of the shoe-mounted connector.

The particular threaded engagement arrangement illustrated and described herein is not a limiting factor. The numerous connection arrangements disclosed in the patents cited in the Background section hereof may also be used by reversing the male and female connector portions between the cleat and the shoe-mounted connector. In addition, connection achieved by rotation of the cleat relative to the shoe-mounted connector is not a limiting feature. It is contemplated that other connection techniques, such a snap fit detent, bayonet, etc., may be utilized with the male connector element affixed to the shoe sole and the female element in the cleat.

Having described preferred embodiments of an improved inverse shoe cleat assembly and method of installation, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. In combination:

a mounting connector adapted to be mounted in the sole of an athletic shoe, said mounting connector including a base and a male engagement member in the form of an externally threaded shaft projecting a predetermined distance from said base beyond said sole;

a cleat adapted to be removably connected to the mounting connector, said cleat including a flange, a plurality of traction elements extending from one surface of said flange away from said mounting connector, and a first annular wall extending from a second surface of said flange toward said mounting connector and having a threaded female receptacle defined on an interior-facing surface of said first wall for threadedly receiving and removably engaging said shaft in response to mutual rotation between said cleat and said connector;

wherein said shaft is formed of plastic material to prevent it from scratching and penetrating vulnerable surfaces when forced directly into contact with said vulnerable surfaces;

locking means responsive to a predetermined extent of rotation of said shaft relative to said receptacle in a first angular direction for resisting turning of said shaft in a second opposite angular direction, said locking means comprising:

a second generally annular wall surrounding said shaft extending axially from said base a distance less than said predetermined distance, said second wall having an interiorly facing surface with a series of angularly spaced short radial projections;

an annular array of angularly spaced posts extending axially from said flange at a radial location at which the posts engage said radial projections in a ratcheting manner to permit relatively free turning of said shaft in said receptacle in said first angular direction and to resist turning of said shaft in said receptacle in said second angular direction.

2. The combination of claim 1 wherein said shaft includes a substantially flat distal end configured to further prevent it from scratching and penetrating vulnerable surfaces when forced thereagainst.

3. The combination of claim 1 wherein said shaft includes a rounded convex distal end configured to further prevent it from scratching and penetrating vulnerable surfaces when forced thereagainst.

4. The combination of claim 1 wherein said locking means is responsive to a predetermined extent of insertion of said shaft into said receptacle for resisting removal of said shaft from said receptacle.

5. The combination of claim 1 wherein said mounting connector is a unitary molded plastic piece.

6. The combination of claim 5 wherein said cleat is a unitary molded plastic piece.

7. The combination of claim 1 wherein said threaded shaft has a multi-start shaft thread; and wherein said receptacle has a multi-start recess thread adapted to receive and threadedly engage the multi-start shaft thread.

8. The combination of claim 7 wherein said multi-start shaft thread is a three-start thread comprising three individual spiral thread segments disposed at 120°-spaced locations about said shaft.

9. The combination of claim 8 wherein each of said shaft thread segments extends the entire length of said shaft and extends along an angle about said shaft of approximately 120°.

10. The combination of claim 8 wherein said multi-start recess thread is a three-start thread comprising three individual spiral thread segments disposed at 120°-spaced locations about said recess;

wherein each of the recess thread segments extends the entire length of said recess and extends along an angle about said recess of less than 120°, whereby full insertion of said shaft into said recess occurs with mutual rotation of no more than 120°.

11. The combination of claim 1 wherein said cleat is a golf cleat.

12. An athletic shoe comprising:

a shoe sole;

a mounting connector adapted to be permanently mounted in said sole of an athletic shoe, said mounting connector includes a projecting male engagement member; and a cleat adapted to be removably connected to the mounting connector;

wherein the cleat includes a female receptacle for receiving and removably engaging the male engaging member;

wherein said projecting male engagement member is formed of plastic material to prevent it from scratching and penetrating vulnerable surfaces when said cleat is removed and said male engagement member is forced against said vulnerable surfaces, wherein said male engagement member comprises an exteriorly threaded shaft;

wherein said female receptacle includes an interiorly threaded recess adapted to receive and threadedly engage said exteriorly threaded shaft upon relative rotation between said shaft and said recess in a first angular direction;

and further comprising locking means responsive to a predetermined extent of rotation of said shaft relative to said recess in said first angular direction for resisting turning of said shaft in said second direction, said locking means comprising:

a plurality of posts disposed on said cleat at substantially equal distances from said recess;

a plurality of radial projections disposed on said mounting connector and extending toward said shaft;

wherein said projections are positioned to engage said posts in a ratcheting like relation as the shaft and recess are mutually rotated during engagement of the cleat and the mounting connector.

13. The athletic shoe of claim 12 wherein said projecting male engagement member has a distal end configured with sufficient surface area to distribute force loads to further prevent it from scratching and penetrating vulnerable surfaces when forced thereagainst.

14. The athletic shoe of claim 12 wherein said mounting connector is molded into said shoe sole.

15. A connector for a affixation to an athletic shoe and adapted to receive replaceable cleats, said connector including a base and a projecting male engagement member in the form of an externally threaded shaft extending a predetermined distance from said base and formed of plastic material to prevent it from scratching and penetrating vulnerable surfaces when forced against said vulnerable surfaces, said connector further comprising a locking member as part of locking means responsive to a predetermined extent of rotation of said shaft relative to a receptacle in at least one of said cleats in a first angular direction for resisting turning of said shaft in a second opposite angular direction, said locking member comprising a generally annular wall surrounding said shaft and extending axially from said base a distance less than said predetermined distance, said second wall having an interiorly facing surface with a series of angularly spaced short radial projections.

16. The combination of claim 15 wherein said projecting male engagement member includes a substantially flat distal end configured to further prevent it from scratching and penetrating vulnerable surfaces when forced thereagainst.

17. The combination of claim 15 wherein said projecting male engagement member includes a rounded convex distal end configured to further prevent it from scratching and penetrating vulnerable surfaces when forced thereagainst.

18. The combination of claim 15 wherein said connector is a unitary molded plastic piece.

* * * * *